US007147123B2

(12) United States Patent
Yamashita

(10) Patent No.: US 7,147,123 B2
(45) Date of Patent: Dec. 12, 2006

(54) METAL CAP

(75) Inventor: Akira Yamashita, Toyama (JP)

(73) Assignee: Takeuchi Press Industries Co., Ltd., Toyama (JP)

( * ) Notice: Subject to any disclaimer, the term of this patent is extended or adjusted under 35 U.S.C. 154(b) by 58 days.

(21) Appl. No.: 10/658,364

(22) Filed: Sep. 10, 2003

(65) Prior Publication Data

US 2005/0051559 A1 Mar. 10, 2005

(51) Int. Cl.
*B65D 51/16* (2006.01)

(52) U.S. Cl. ..... 220/366.1; 215/328

(58) Field of Classification Search ..... 220/366.1, 220/360–365, 367.1; 215/329, 328, 307, 215/260, 232, 324–327, 311; *B65D 51/16, B65D 41/34*

See application file for complete search history.

(56) References Cited

U.S. PATENT DOCUMENTS

| | | | | | |
|---|---|---|---|---|---|
| 3,713,545 | A * | 1/1973 | Lawrence et al. | ..... | 215/260 |
| 4,007,851 | A * | 2/1977 | Walker | ..... | 215/307 |
| 4,611,723 | A * | 9/1986 | Megowen | ..... | 215/252 |
| 6,010,028 | A * | 1/2000 | Jordan et al. | ..... | 220/669 |
| 6,202,871 | B1 * | 3/2001 | Kelly | ..... | 215/307 |

FOREIGN PATENT DOCUMENTS

| | | | | | |
|---|---|---|---|---|---|
| JP | 1-99967 | * | 4/1989 | ..... | 220/366 |
| JP | 5-65151 | * | 3/1993 | ..... | 220/366 |
| JP | 9-328158 | * | 12/1997 | ..... | 215/307 |
| JP | 2002-211603 | * | 7/2002 | ..... | 220/366 |
| JP | 2003-72798 | * | 3/2003 | ..... | 220/336 |
| JP | 2004-175388 | * | 6/2004 | ..... | 215/307 |
| JP | WO 2004/063044 A1 | * | 7/2004 | ..... | 215/307 |
| JP | 2004-217295 | * | 8/2004 | ..... | 220/336 |
| JP | 2004-269016 | * | 9/2004 | ..... | 215/307 |
| JP | 2004-291979 | * | 10/2004 | ..... | 215/307 |

* cited by examiner

*Primary Examiner*—Lien M. Ngo
(74) *Attorney, Agent, or Firm*—Rader, Fishman & Grauer PLLC; Carl Schaukowitch

(57) ABSTRACT

A metal cap 3 for a container, the metal cap having a knurl part formed on the outer perimeter thereof so as to release outside the inner pressure of the container generated from the content such as carbonated drinks etc., wherein the knurl part comprises plural of knurls 6 having short width slits 6*a* and plural of knurls 7 having long width slits 7*a*, and knurls 7 is formed in the mixture with knurls 6.

11 Claims, 11 Drawing Sheets

METAL CAP

FIELD OF THE ART

This invention generally relates to a metal cap for containers containing carbonated drinks etc., and more particularly to a metal cap which is prevented from blasting off by releasing outside the pressure in the container when the inner pressure becomes abnormally high.

BACKGROUND ART

As shown in FIG. 18, on the upper perimeter of a metal cap 50, plural of knurl part 51 having a short width slit 51*a* are formed. Practically, in the case of the metal cap 50 whose outer diameters is 35 to 40 mm, twenty five to thirty of knurl part 51 having the short width slit 51*a* of about 2 mm long are formed. The function of the knurl part 51 having the short width slits 51*a* is to prevent the content from spouting out at the opening of the metal cap by somewhat releasing the pressure generated from carbonated drinks outside through the slit 51*a* of the knurl part 51 when a consumer turns the metal cap 50 in order to open for drinking. In other words, the slits are formed so as to previously release somewhat pressure outside in opening of the cap. More specifically, in FIG. 19, when the metal cap 50 is turned about one forth of the total angle, the contact between the top surface of a curled portion 54 formed on top of the mouth part 53 and the packing 55 attached on the rear surface of the metal cap become loose to yield a gap in between them. The pressure generated from the carbonated drinks is released instantly outside, passing through the gap, through the plural of knurl part 51 with short width slit 51*a*. In the conventional metal cap, a hem with a bridge is formed under the lower edge, and the bridge is cut by turning of the metal cap when opened.

DISCLOSURE OF INVENTION

In conventional technologies, the knurl parts are formed to previously prevent the content such as cola etc. from spouting out during the opening of the cap. There are two conditions for containers to be left unattended due to carelessness in a vehicle or in a room; the one is the case container to be left behind without opening the cap, and another is the case container to be left behind after opening the cap for drinking, and capping again to close the container. In either case, the inner pressure of the container becomes abnormally high when the ambient temperature of the container becomes abnormally high. It will result in very dangerous condition that the metal cap may blast off from the container at its critical limit. There has been taken no countermeasures against these cases in conventional technologies.

This invention is directed to solve the above problems of conventional technologies providing a metal cap prevented from blasting off, by automatically deforms itself and release the inner pressure of the container outside, when the inner pressure of the container becomes abnormally high by leaving the container in a vehicle or a room.

In order to solve the problem according to the present invention, there is provided a metal cap having knurl part with slits formed on an outer perimeter so as to release outside an inner pressure of the container generated from content such as cola etc., wherein the knurl part comprises plural of knurls having short width slits and at least one knurl having a long width slit; and the knurl having long width slit is formed in a mixture with the knurl having short width slit.

According to another aspect of the present invention, there is provided a metal cap having knurl part with slits formed on an outer perimeter so as to release outside an inner pressure of the container generated from content such as cola etc., wherein the knurl part comprises plural of knurls having slits, and at least one communicating slit is formed in a gap between the adjacent knurls communicating the adjacent slits to form a long width slit.

In above-mentioned metal cap, it is preferable that the short width slit or the long width slit is formed as being extended from right or left edge of the knurl.

DESCRIPTION OF PREFERRED EMBODIMENTS

Figure 1:
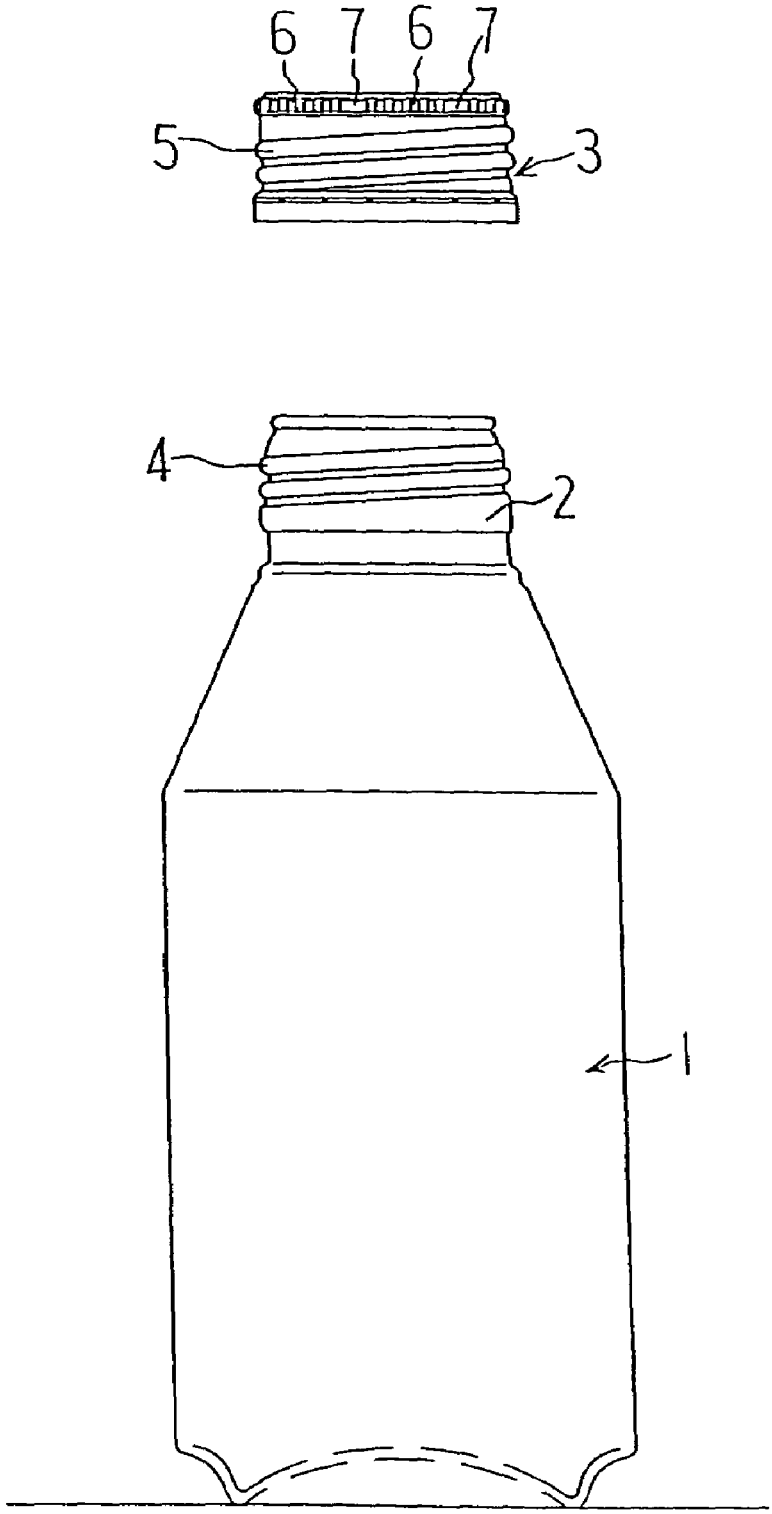
FIG. 1 is an elevation view of the metal cap and the container showing the first preferred embodiment of the invention.
Figure 2:
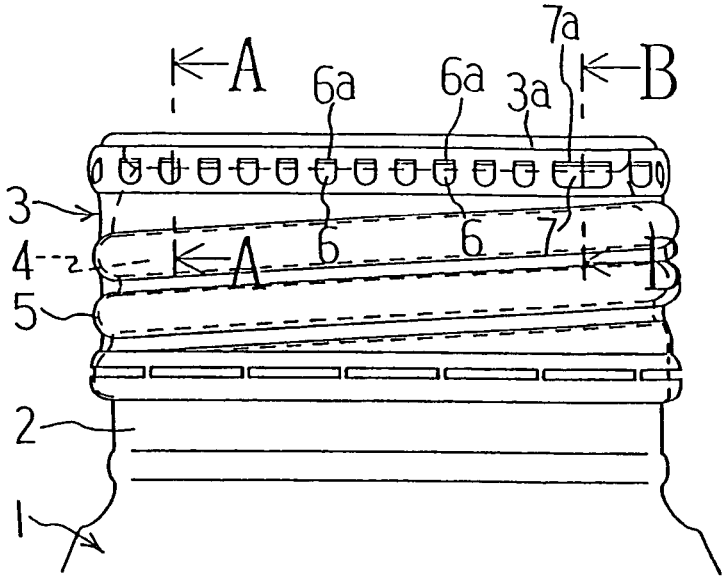
FIG. 2 is an enlarged elevation view of the metal cap showing the first embodiment of the invention.
Figure 3:
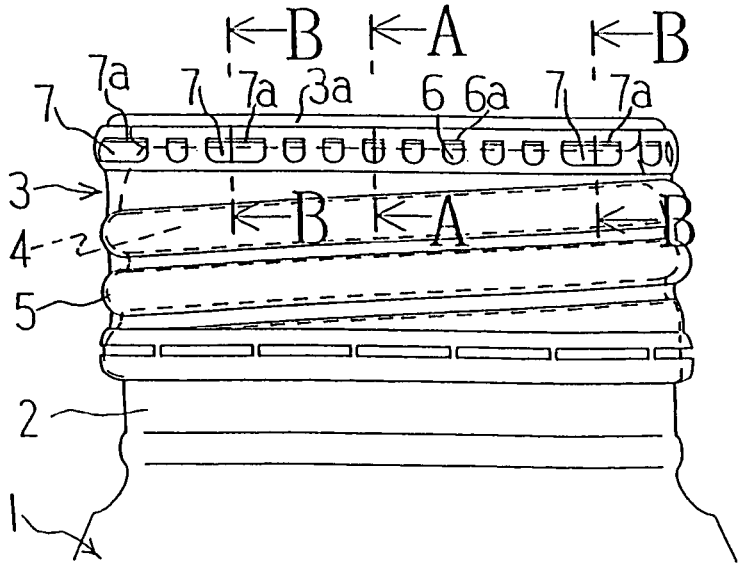
FIG. 3 is an expanded elevation view of the metal cap showing the other preferred embodiment of the invention.

The embodiments of this invention are described bellow according to drawings. FIGS. 1 to 7 are the preferred embodiments of the metal cap of this invention. FIG. 2 shows a metal cap provided with twenty-six knurls, each having short width slit (about 2.0 mm) and a knurl having long width slit (about 6.0 mm) formed on the outer perimeter of a metal cap. FIG. 3 shows a metal cap provided with twenty-two knurls, each having short width slit (about 2.0 mm) and three knurls, each having long width slit (about 6.0 mm) formed on the outer perimeter of a metal cap, wherein the knurl with long width slits are located arbitrarily in between the knurls with short width slits.

Reference numeral 1 is a container made of metal such as aluminum etc., synthetic resin, or glass etc. The container 1 is filled with carbonated drinks, beers etc. On a mouth part 2 of the container 1, a male screw 4 is formed where a female screw 5 of the metal cap 3 is engaged. As a means of increasing the withstanding pressure of the metal cap to prevent the metal cap from blasting off, extending the length of engagement (thread height) of the male screw 4 and female screw 5 or increasing the number of threads (turns) of the male screw 4 and the female screw 5 can be thought. However, these means cause to increase the required torque extraordinarily, to open the metal cap and spoil the user's sense of opening the cap. Consequently, for such container 1 and the metal cap 3, the length of engagement (thread height) of the male screw 4 and the female screw 5 has no other choice than to be made shallow, and number of screw threads (turns) of the male screw 4 and the female screw 5 are restricted to be few.

Considering these point described above, the inventor of this invention got an idea to avoid the danger of the metal cap 3 from blasting off by releasing the pressure outside by automatically and intentionally deforming the metal cap before the inner pressure of the container becomes greater than 1 MPa and before the danger of blasting off of the metal cap occurs, more specifically the pressure reaches 0.7 to 0.8 MPa.

The metal cap of this invention is characterized in that the width of the slit of the knurl formed on the outer perimeter of the metal cap 3.

As shown in FIG. 2, the metal cap 3 comprises, a main body with thread in a shape of cylinder with upper base, a hem part with bridge formed on the bottom of the main body, and a knurl part formed on the upper part of the main body. The hem part, as known, is to avoid the metal cap from blasting before opening and it separates from the main body when the cap is been turned for opening. The knurl part, as known, is made of plural of concaved knurls, which makes the handler to easily grip the metal cap 3, especially at the time of opening the metal cap. This metal cap 3 is characterized in the knurl part, which comprise plural of a concaved narrow knurls 6 and a concaved wide knurl 7, wherein each knurl 6 and knurl 7 has a slit 6*a*, and a slit 7*a* along the top of the knurl 6 or 7, having the same length as the knurl 6 and 7. In other words, there is a step between the top of the knurl 6 or 7 and the knurl part above the knurl 6 or 7 and this step forms the slit 6*a* or 7*a* (see FIGS. 6 and 7). This long width slit 7*a* release the inner pressure of the container, when the inner pressure abnormally increases. In this embodiment, this slit 6*a* or 7*a* is formed on the top of the knurl 6 or 7, but it can be formed along the bottom line of the knurl.

Figure 4:
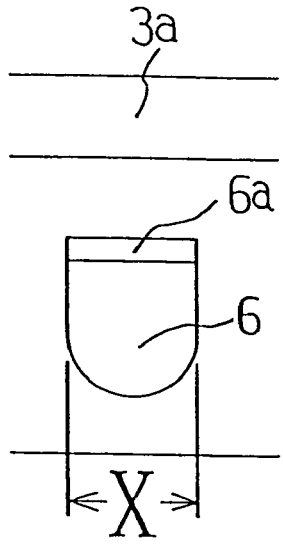
FIG. 4 is an expanded elevation view of the knurl part having short width slit in the metal cap.
Figure 5:
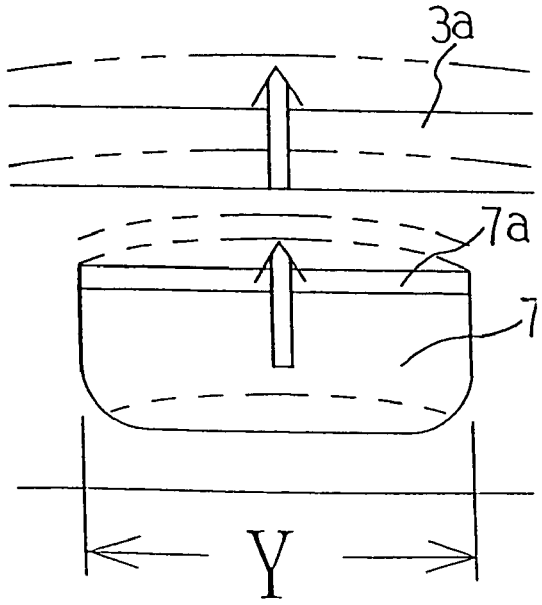
FIG. 5 is an expanded elevation view of the knurl part having long width slit in the metal cap.
Figure 6:
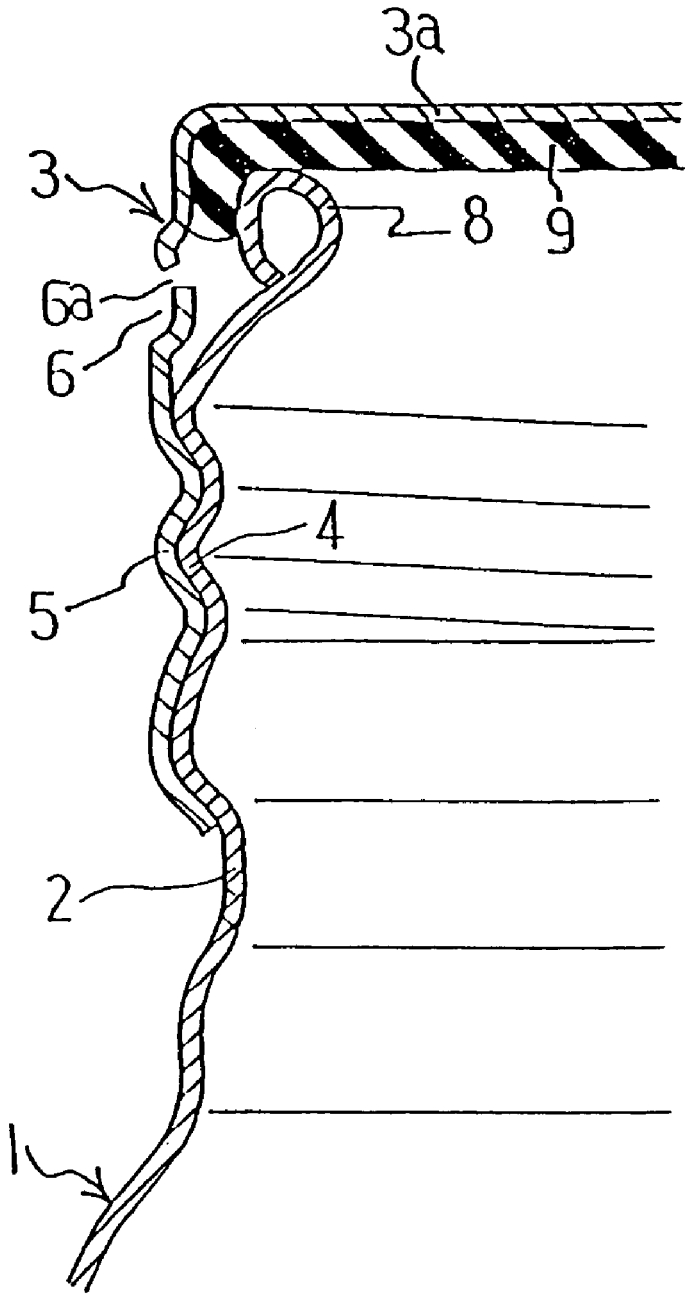
FIG. 6 is an expanded side view along A—A line of FIG. 2.
Figure 7:
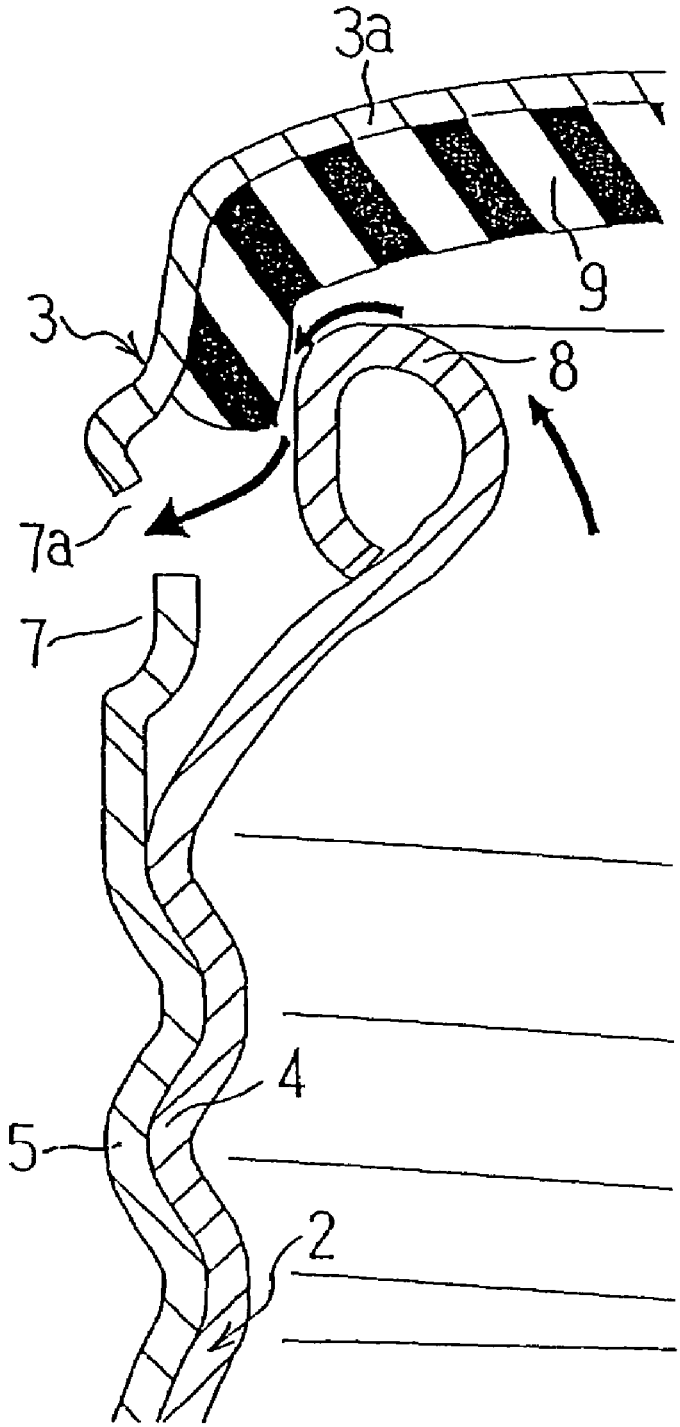
FIG. 7 is an expanded side view along B—B line of FIG. 2.

Further, FIG. 3 shows the metal cap 3 which comprises a knurl part having twenty-two narrow knurls 6 with short width slit 6*a* and three knurls 7 with long width slit 7*a* formed on the outer perimeter of the metal cap 3, wherein the knurls 6 and knurl 7 are formed in a mixture. It goes without saying that the number of knurl 7 having long width slit 7*a* can be determined arbitrarily considering the capacity of the container, diameter of the mouth part, material of the container, kind of the contents, and the inner pressure. However, it is preferable that the knurls 7 with long width slit are placed equally in same intervals on the outer perimeter of the metal cap. And further, if necessary, it is possible to form the long width slit 7*a* or the short width slit 6*a* being extended from the right or the left edge of knurl 6 and knurl 7, thereby enabling to form a wider slit. For the width X of the knurl 6 as shown in FIG. 4 having short width slit 6*a* of about 1.0 to 3.0 mm is suitable. For the width Y of the knurl 7 as shown in FIG. 5 having long width slit 7*a* of about 4.0 to 7.0 mm is suitable. FIG. 6 and FIG. 7 show enlarged cross section along A—A and B—B of FIGS. 2 and 3. In this invention, the knurl 6 having short width slit 6*a* functions as is the case with the conventional knurl described above. In other words, it functions to release outside somewhat pressure of the contents from the short slits 6*a* during the opening of the cap.

The action of the embodiments of the metal cap of this invention is described bellow. When the inner pressure of the container of carbonated drinks such as cola, etc. left behind in a vehicle, in a room becomes abnormally high, the metal cap 3 of this invention acts as shown in FIG. 5. The knurl 7 having long width slit 7*a* and its top surface 3*a* vaults and deforms as shown by imaginary line (two dot-dashed lines) due to the pressure. As shown in FIG. 7, this popping up and deformation cause the top surface of the metal cap 3*a* and the packing 9 to detached from the curled portion 8 formed on the edged of the mouth part 2 and release the pressure outside from the detached gap through the slit 7*a*.

Resultantly, in the metal cap 3 of this invention, the metal cap 3 automatically deforms to release the pressure outside enabling to avoid the emergent blasting off of the metal cap 3.

Figure 8:
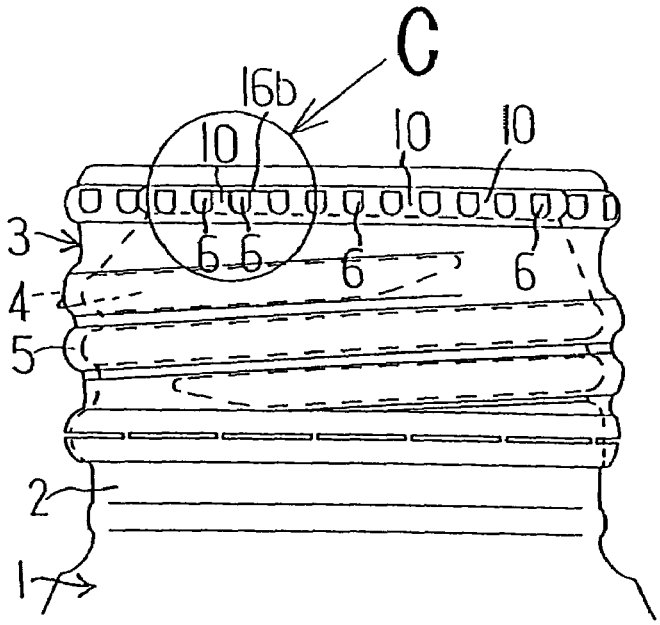
FIG. 8 an elevation view of the metal cap and the container showing another preferred embodiment of the invention.
Figure 9:
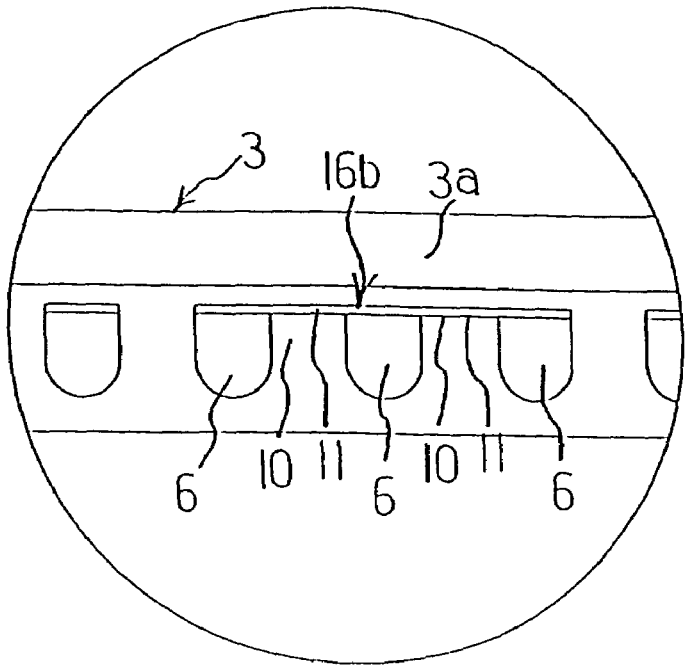
FIG. 9 is an expanded elevation view of C part.

FIG. 8 and FIG. 9 show the other preferred embodiment of this invention. All the knurls 6 formed in this metal cap 3 have the same width like the conventional metal cap. This metal cap 3 is characterized in that a new slit 11 is formed in the gap 10 between the adjacent knurls 6. Further, the slits 6*a* of three adjacent knurls 6 are communicated each other by the new slit 11 to form a long width slit 16*b*. Other part of this metal cap is substantial the same as the metal cap 3 of FIG. 2.

Figure 10:
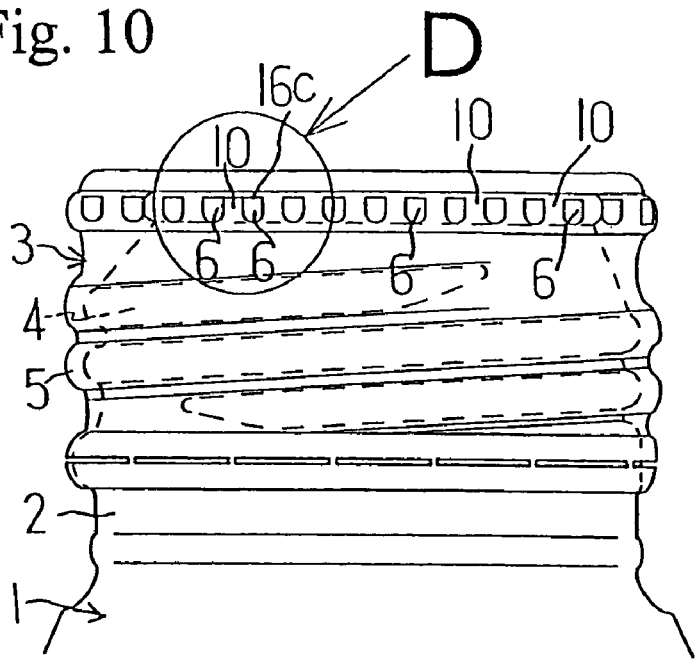
FIG. 10 is an elevation view of the metal cap and the container showing the still other preferred embodiment of the invention.
Figure 11:
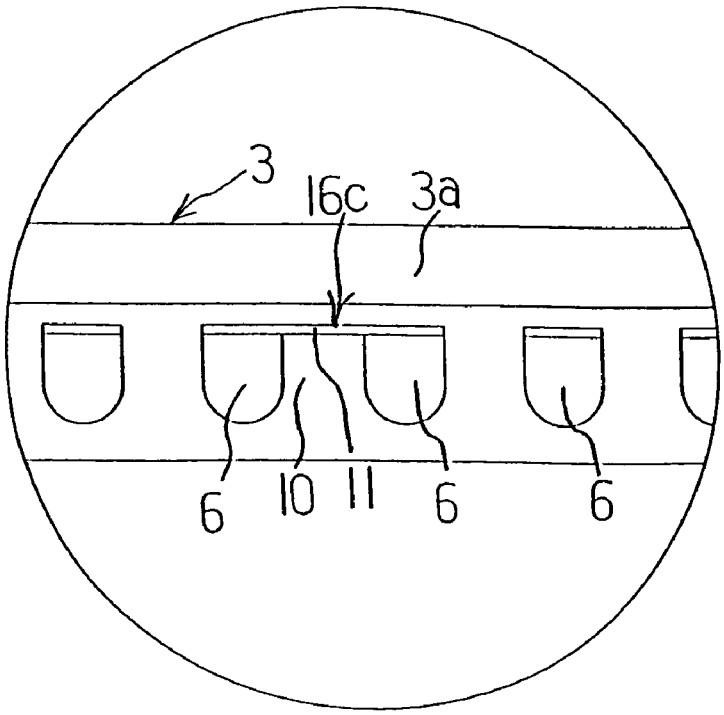
FIG. 11 is an expanded elevation view of D part.

FIG. 10 and FIG. 11 show another preferred embodiment of this invention. This metal cap 3 also has a new slit 11 between the gap 10 of adjacent knurls 6, and the slits 6*a* of two adjacent knurl parts 6 are communicated each other to form a long width slit 16*c*.

Figure 12:
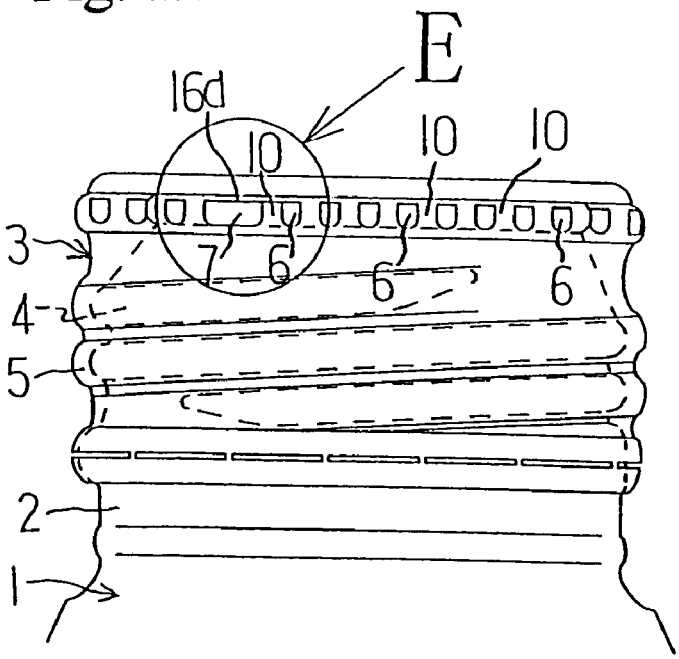
FIG. 12 is an elevation view of the metal cap and the container showing the still other preferred embodiment of the invention.
Figure 13:
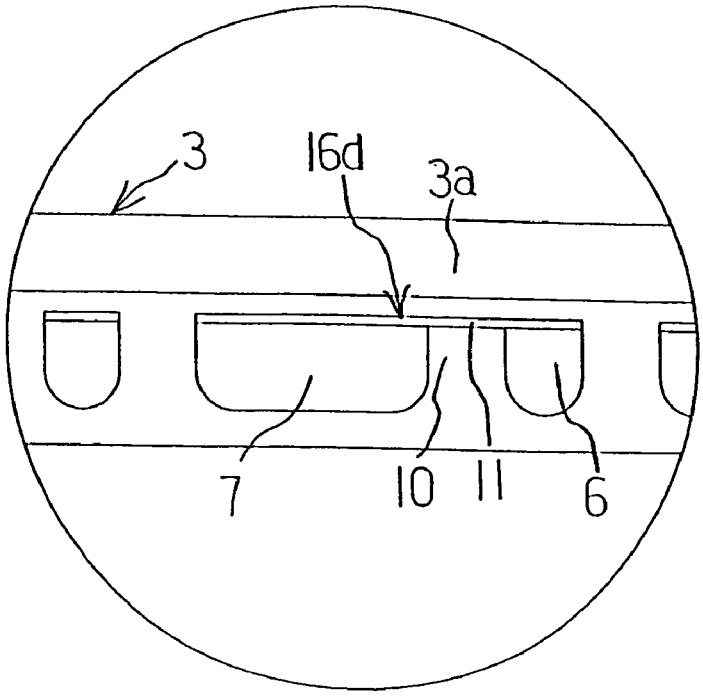
FIG. 13 is an expanded elevation view of E part.
Figure 14:
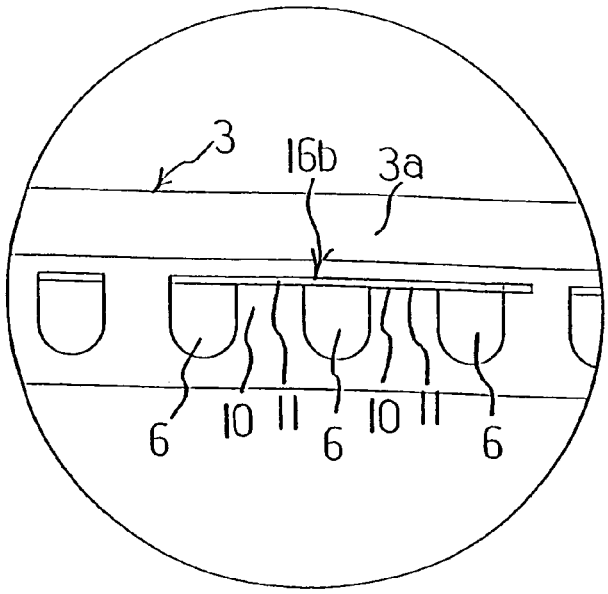
FIG. 14 is another preferred embodiment of expanded elevation view of C part.
Figure 15:
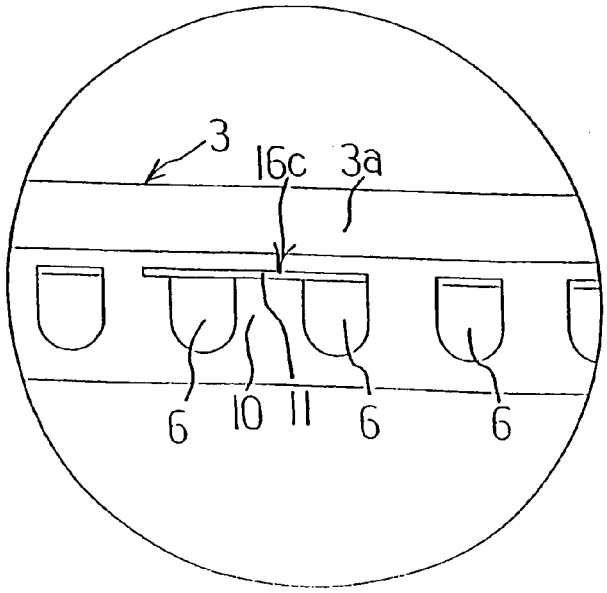
FIG. 15 is another preferred embodiment of expanded elevation view of D part.
Figure 16:
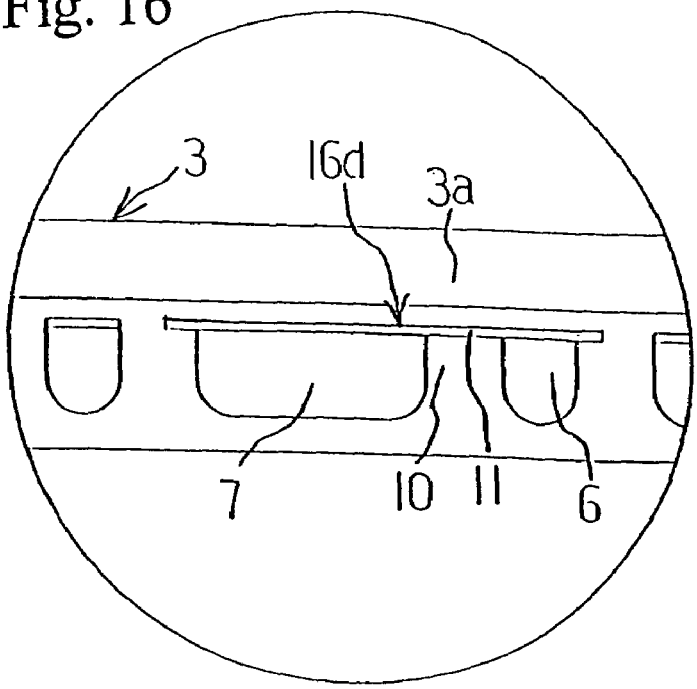
FIG. 16 is another preferred embodiment of expanded elevation view of E part.
Figure 17:
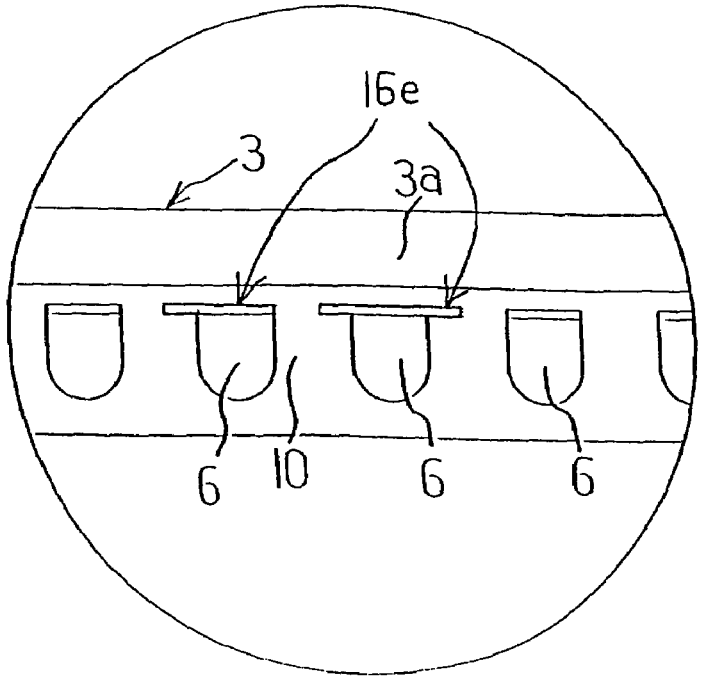
FIG. 17 is other preferred embodiment of the metal cap showing the knurl part.
Figure 18:
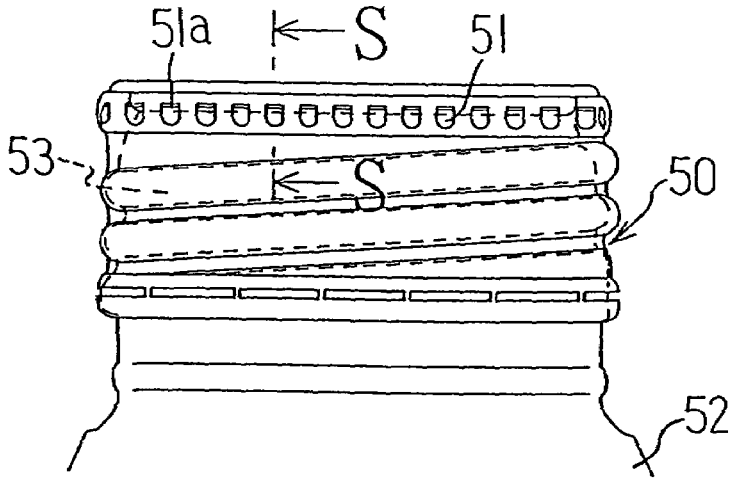
Fig. 18 PRIOR ART
FIG. 18 is an elevation view showing conventional metal caps being engaged.
Figure 19:
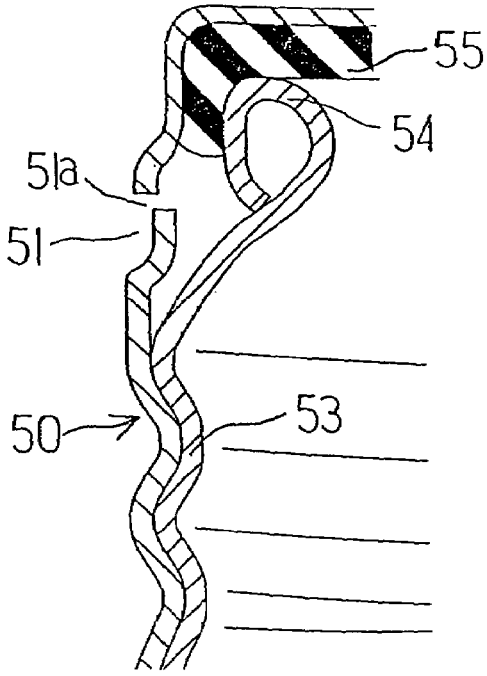
Fig. 19 PRIOR ART
FIG. 19 is an expanded cross section along S—S line of FIG. 18.

FIG. 12 and FIG. 13 show still other embodiment of this invention. This metal cap comprises the knurl part having plural of the concaved narrow knurls 6 with short width slit 6*a*, and a concaved wide knurl 7 with long width slit 7*a*, like the metal cap 3 of the FIG. 1. This metal cap 3 is characterized in that a new slit 11 is formed in the gap 10 between the adjacent knurl 6 and knurl 7, wherein the slits 6*a* and 7*a* of two adjacent knurls 6 and 7 are communicated each other to form a longer width slit 16*d*.

It goes without saying that how many long width slit 16*b*, 16*c* and 16*d* are formed on the perimeter of the metal cap 3. It can be determined arbitrarily considering the capacity of the container, diameter of the mouth part, material of the container, kind of the contents, and the pressure. And further, if necessary, it is possible to extend the right edge or the left edge of the long width slit 16*b*, 16*c*, 16*d*, and 16*e* to the each adjacent gap 10 to form a longer slit (see FIG. 14–17).

The long width slit 16*b*, 16*c*, 16*d*, and 16*e* functions as mentioned before. It vault, deforms and pops up to release the pressure outside when the inner pressure of the container increases abnormally.

The results of the inner pressure leak tests are shown bellow.

(1)(Test Conditions)

Outer diameter of the container: 66 mm, Height of the container: 164 mm,

Outer diameter of the mouth part: 37.8 mm, Thickness of the container shell: 0.135 mm Effective number of the thread (turns): 1.7 turn, Outer diameter of the metal cap (Diameter of the knurl part): 38.5 mm Number of the knurls: twenty-eight knurls having short width slit (about 2.0 mm)

Number of the knurls: Zero knurl having long width slit (about 6.0 mm)

Supply air from the bottom of the metal-capped container to increase the inner pressure gradually, and examine the pressure at which the metal cap blast off.

Number of the tests: N=3

| Conventional metal cap | The pressure at which the metal cap blasted off (MPa). |
|---|---|
| Never opened | 1.08 (Ave.) |
| Once opened and recapped | 0.85 (Ave.) |

(2)(Test Conditions)

Outer diameter of the container: 66 mm, Height of the container: 164 mm,

Outer diameter of the mouth part: 37.8 mm, Thickness of the container shell: 0.135 mm Effective number of the thread (turns): 1.7 turns, Outer diameter of the metal cap (Diameter of the knurl part): 38.5 mm Number of the knurls: Twenty-six knurls having short width slit (about 2.0 mm)

Number of the knurls: One knurl having long width slit (about 6.0 mm)

Supply air from the bottom of the metal-capped container to increase the inner pressure gradually, and examine the pressure at which the leak occurred.

Number of the tests: N=12

| One knurl having long width slit formed | The pressure at which the leak occurred (MPa). |
|---|---|
| Never opened | 0.83 (Ave.) |
| Once opened and recapped | 0.75 (Ave.) |

(3)(Test Conditions)

Outer diameter of the container: 66 mm, Height of the container: 164 mm,

Outer diameter of the mouth part: 37.8 mm, Thickness of the container shell: 0.135 mm Effective number of the thread (turns): 1.7 turns, Outer diameter of the metal cap (Diameter of the knurl part): 38.5 mm Number of the knurls: twenty-two knurls having short width slit (about 2.0 mm)

Number of the knurls: Three knurls having long width slit (about 6.0 mm)

Supply air from the bottom of the metal-capped container to increase the inner pressure gradually, and examine the pressure at which the leak occurred.

Number of the tests: N=3

| Three knurls having long width slit formed | The pressure at which the leak occurred (MPa). |
|---|---|
| Never opened | 0.79 (Ave.) |
| Once opened and recapped | 0.69 (Ave.) |

According to the test results (2) and (3), the use of the metal cap of this invention automatically released the inside pressure of the container outside at the pressure of 0.7 Mpa to 0.8 Mpa before reaching greater than 1 Mpa. The test results also proved that formation of at least more than three knurls having long width slit enables more stable release of the inner pressure preventing the metal cap from blasting off securely.

As described above, because this invention allows the inner pressure of the container to automatically release outside before the pressure reaches a limit, danger of emergent blasting off of the metal cap in the conventional container left behind in a vehicle with its inner pressure rising above 1 Mpa can be securely avoided.

The invention claimed is:

1. A metal cap for a container, the metal cap having a top part and a side part connected to and extending peripherally around the top part to form a generally cylindrically shaped cavity with a packing disposed in the cavity and contacting the top part and an upper portion of the side part adjacent the top part, the metal cap having a knurl part with slits formed on an outer perimeter thereof so as to release outside an inner pressure of the container generated from contents contained therein, wherein the knurl parts comprises, plural of knurls having short width slits and at least one knurl having a long width slit; and the knurl having long width slit is formed in a mixture with the knurls having short width slits and wherein the plural of knurls having short width slits and the knurl having the long width slit are formed on and about the side part, the short width slits and the long width slit extending through the side part adjacent the upper portion of the side part yet disposed apart from the packing.

2. A metal cap for a container, the metal cap having a top part and a side part connected to and extending peripherally around the top part to form a generally cylindrically shaped cavity with a packing disposed in the cavity and contacting the top part and an upper portion of the side part adjacent the top part, the metal cap having an upper outer perimeter, a lower outer perimeter and a knurl part with slits, the knurl part formed between the upper outer perimeter and the lower outer perimeter with the slits disposed adjacent the upper outer perimeter so as to release outside an inner pressure of the container generated from contents contained therein, wherein the knurl part comprises plural of knurls having slits disposed adjacent the upper outer perimeter; and at least one communicating slit disposed adjacent the upper outer perimeter is formed in a gap between the adjacent knurls communicating the adjacent slits to form a long width slit and wherein the slits and the at least one communicating slit are formed about the side part, extend through the side part adjacent the upper portion of the side part and are disposed apart from the packing.

3. A metal cap according to claim 1, wherein;

the short width slit or the long width slit is formed as being extended outside from right or left edge of the knurl.

4. A metal cap according to claim 2, wherein;

the slit or the long width slit is formed as being extended outside from right or left edge of the knurl.

5. A metal cap having a top part and a side part connected to and extending peripherally around the top part to form a generally cylindrically shaped cavity with a packing disposed in the cavity and contacting the top part and an upper portion of the side part adjacent the top part, the metal cap being threadably engaged onto a mouth portion of a container such that a rim defining a mouth of the container engages an outer peripheral portion of the packing so as to seal pressurized contents of the container contained therein to a predetermined pressure, the metal cap comprising:

a plurality of knurls formed on and about the side part, at least one knurl formed with a slit extending through the side part adjacent the upper portion thereof and disposed apart from the packing, the slit sized in a manner such that, when an internal pressure of the container exceeds the predetermined pressure, a part of the upper portion of the metal cap adjacent and partially defining the slit deforms by an amount sufficient to cause disengagement between a section of the packing and a section of the rim thereby relieving a portion of the internal pressure exceeding the predetermined pressure.

6. A metal cap according to claim 5, wherein relieving the portion of the internal pressure exceeding the predetermined pressure occurs without turning the metal cap portion and the container relative to each other.

7. A metal cap according to claim 5, wherein the at least one slit extends in a peripheral direction.

8. A metal cap for a container, the metal cap having a top part and a side part connected to and extending peripherally around the top part to form a generally cylindrically shaped cavity with a packing disposed in the cavity and contacting the top part and an upper portion of the side part adjacent the top part, the metal cap having a knurl part that includes plural of knurls with slits formed on an outer perimeter thereof so as to release outside an inner pressure of the container generated from contents contained therein, wherein a long slit longer than the slits formed on the plural of knurls is formed between consecutive ones of the knurls and wherein the slits and the long slit are formed about the side part, extend through the side part adjacent the upper portion of the side part and are disposed apart from the packing.

9. A metal cap according to claim 1, wherein the long width slit is sized in a manner such that, when an internal pressure of the container exceeds the predetermined pressure, a part of the upper portion of the metal cap adjacent and partially defining the long width slit deforms by an amount sufficient to cause disengagement between a section of the packing and a section of the rim thereby relieving a portion of the internal pressure exceeding the predetermined pressure.

10. A metal cap according to claim 1, wherein the knurl part comprises a plurality of short width knurls having a short width slit and a long width knurl having long width slit.

11. A metal cap according to claim 10, wherein the width of each short width knurl having short width slit is the same as the width of the short width slit and the width of the long width knurl having long width slit is same as the width of the long width slit.

* * * * *